219-121 SR
8/25/81 XR 4,286,250

United States Patent [19]
Sacchetti

[11] 4,286,250
[45] Aug. 25, 1981

[54] LASER FORMED RESISTOR ELEMENTS

[75] Inventor: Peter J. Sacchetti, Manchester, N.H.

[73] Assignee: New England Instrument Company, Natick, Mass.

[21] Appl. No.: 36,811

[22] Filed: May 4, 1979

[51] Int. Cl.[3] ..... H01C 1/012

[52] U.S. Cl. ..... 338/306; 29/610 R; 29/613; 219/121 L; 219/121 LM; 219/552; 219/553; 338/334; 338/311; 338/195

[58] Field of Search ..... 219/528, 553, 549, 552, 219/121 LH, 121 LV, 121 LE, 121 LF, 121 EF, 121 EG, 121 EJ, 121 EK; 338/211, 212, 209, 195, 225, 226, 274, 275, 285, 300, 306, 304, 334, 305, 311; 423/445, 447.2, 447.9; 252/502; 427/101; 29/610, 611, 613

[56] References Cited

U.S. PATENT DOCUMENTS

| | | | |
|---|---|---|---|
| 2,985,860 | 5/1961 | Moren | 219/578 X |
| 3,056,881 | 10/1962 | Schwarz | 219/121 EM X |
| 3,243,590 | 3/1966 | Forsman et al. | 219/553 X |
| 3,404,032 | 10/1968 | Collins | 338/300 X |
| 3,530,822 | 1/1976 | Elmer | 427/101 X |
| 3,645,783 | 2/1972 | Rupert et al. | 338/309 X |
| 3,748,174 | 7/1973 | Chen et al. | 338/23 X |
| 4,036,786 | 7/1977 | Tiedemann | 338/308 X |

FOREIGN PATENT DOCUMENTS

| | | |
|---|---|---|
| 68637 | 10/1973 | Luxembourg . |
| 562504 | 4/1975 | Switzerland . |
| 2124361 | 9/1972 | United Kingdom . |
| 1346517 | 2/1974 | United Kingdom . |

*Primary Examiner*—C. L. Albritton
*Attorney, Agent, or Firm*—John E. Toupal

[57] ABSTRACT

The invention is an electrical component with a body element comprising an organic substrate portion and a laser formed, resistor portion carburized thereon. A first electrical conductor is electrically connected to one location on the resistor portion so as to form one terminal for connection to an electrical circuit and a second electrical conductor is electrically connected to the resistor portion at a different location so as to form another terminal for connection to the electrical circuit.

22 Claims, 7 Drawing Figures

LASER FORMED RESISTOR ELEMENTS

BACKGROUND OF THE INVENTION

This invention relates generally to electrical resistors and, more particularly, to laser formed, carburized substrate resistor elements and to a method for their manufacture.

Electrical resistors are utilized in the vast majority of electrical and electronic circuits. Although other types exist, the use of carbon containing resistors is widespread because of various factors including relatively low cost and good operational characteristics. Carbon resistors are produced by a wide variety of processes combining carbon with a binder or screening carbon and a binder onto a substrate followed by a bake cycle. All such processes exhibit both advantages and disadvantages. Thus, a continuous need exists for improved methods of producing carbon containing electrical resistors.

The object of this invention, therefore, is to provide a new and useful method for producing electrical resistors and, more particularly, for producing carbon containing electrical resistors.

SUMMARY OF THE INVENTION

The invention is an electrical component with an organic substrate portion of a homogeneous organic body element and a resistor portion carburized from that body element. A first electrical conductor is electrically connected to one location on the resistor portion so as to form one terminal for connection to an electrical circuit and a second electrical conductor is electrically connected to the resistor portion at a different electrical circuit. The resulting resistor is easier to manufacture than present techniques since the only material needed to produce the resistor is the substrate from which the resistors are created by the selected application of thermal energy. In addition, the resistor has performance characteristics superior to so-called carbon composition resistors and at least equivalent to so-called carbon film resistors. Carburizing a given portion of an organic substrate establishes a carbon resistor element in a relatively simple and low cost manner.

In accordance with additional features of the invention, the electrical conductors are secured to the carburized resistor portion with an electrically conductive epoxy and the resistor portion is covered with an electrically insulative coating. These features enhance the structural stability of the somewhat brittle carburized resistor.

Preferred embodiments of the invention include one or more linear carburized resistor portions formed on the planar surface of a substrate, a spiral carburized resistor portion formed on the surface of a cylindrical substrate and a carburized resistor element having a third conductor connected between a pair of conductors connected to opposite ends thereof. The planar and cylindrical susbtrates provide resistors in the forms commonly employed in electronic circuits, the multiple resistor embodiments permit the creation of resistor networks and the multi-electrode resistor element can be used in suitable applications as a voltage divider.

Another feature of the invention is the provision of a method for producing electrical resistor elements of the type described above. The method includes the steps of forming an organic substrate, applying heat so as to carburize a predetermined resistor portion of the substrate and attaching electrical conductors to different locations on the resistor portion so as to provide electrical terminals therefor.

In a preferred embodiment of the method described above, a laser beam is directed onto a Kapton Polyimide substrate so as to carburize the resistor portion thereof. Polyimide is specifically well suited for use as a resistor substrate and a laser is an efficient and effective carburizing vehicle.

According to other featured steps of the method, conductors are secured to the carburized resistors with an electrically conductive epoxy and the carburized resistor portion is covered with an electrically insulative coating. As noted above, these steps enhance the structural stability of the resistor elements.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
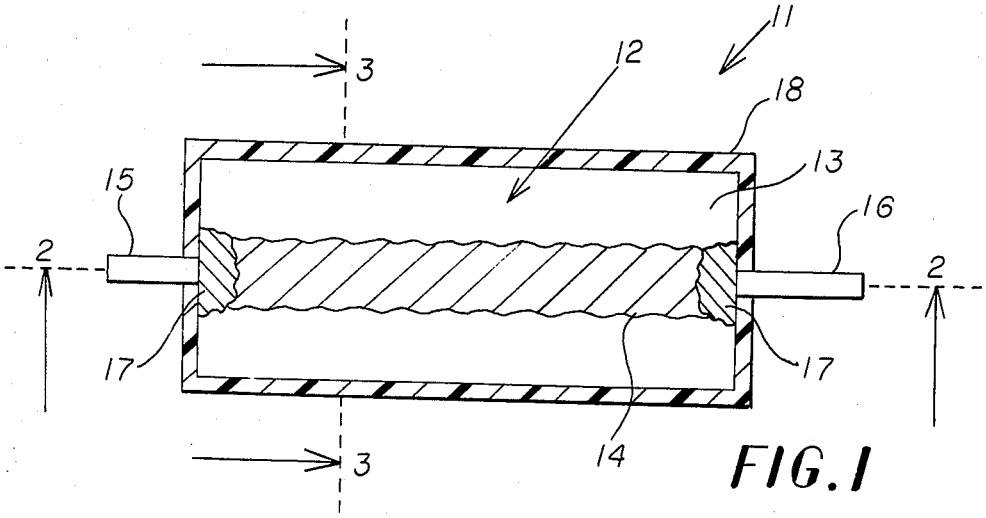
FIG. 1 is a schematic cross-sectional view of one resistor embodiment of the invention.
Figure 2:
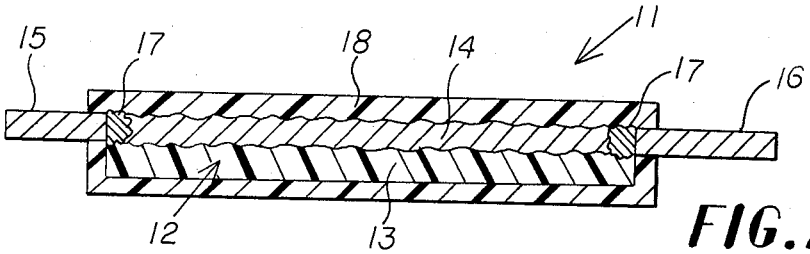
FIG. 2 is a schematic cross-sectional view of the embodiment shown in FIG. 1 taken along lines 2—2.
Figure 3:
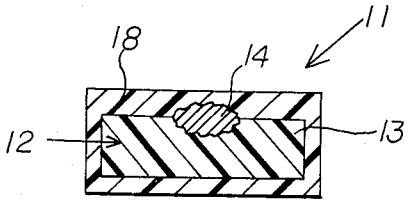
FIG. 3 is a schematic cross-sectional view of the embodiment shown in FIG. 1 taken along lines 3—3.

Schematically illustrated in FIGS. 1–3 are cross-sectional view of one electrical component embodiment 11 of the invention. Included in the component 11 is an organic plastic body element 12 formed by a planar substrate portion 13 and an elongated, rectilinear carburized plastic resistor portion 14. The body element 12 is formed by selectively applying heat to the homogeneous organic substrate 13 so as to carburize only the resistor portion 14 thereof. Preferably, heat is applied in the form of a laser beam that is selectively directed onto the substrate portion 13. Polyimides are suitable for use as the substrate 13 and a particular Polyimide sold under the trademark Kapton of E. I. DuPont Company has been found particularly desirable for this application. However, also suitable are other engineering high temperature plastics such as polysulfone, polyphenylene sulfide, poly (amide-imide), and fluoroplastics. Also it should be noted the substrate need not be exclusively confined to solid plastic but can comprise other organic materials such as paper or can be formed from metals or ceramics which have been conformally coated or laminated with one of the previously mentioned organic materials. Electrically connected to one end of the resistor portion 14 is an end of an electrical conductor 15, the opposite end of which is adapted for connection to an electrical circuit (not shown). The opposite end of the resistor portion 14 is similarly connected to one end of an electrical conductor, the opposite end of which is adapted for connection to an electrical circuit (not shown). Securing the conductors 15 and 16 to the resistor portion 14 is a suitable adhesive which is applied, for example, as a drop of uncured conductive epoxy and then cured. The entire body element 12 is encapsulated by a protective, electrically insulative enclosure 18 applied, for example, as a conformal coating of epoxy. Transfer molding techniques can also be utilized to form an epoxy enclosure for the body element 12. The enclosure 18 provides structural stability for the somewhat brittle carburized resistor portion 14.

Figure 4:
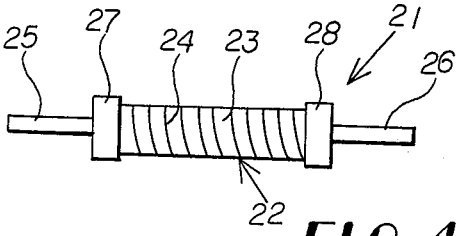
FIG. 4 is a schematic view of another resistor embodiment of the invention.

FIG. 4 schematically illustrates another electrical component embodiment 21 of the invention. A cylindrical body element 22 comprises a cylindrical substrate portion 23 and a carburized plastic resistor portion 24. The resistor portion 24 is formed as a spiral on the outer surface of the cylindrical substrate portion 23. A pair of electrical conductors 25 and 26 are secured to opposite ends of the spiral resistor portion 24 by, respectively, conductive end caps 27 and 28. As above, the body element 22 is preferably produced by selectively directing a laser beam along the surface of the substrate 23 so as to carburize thereon the spiral resistor portion 24.

Figure 5:
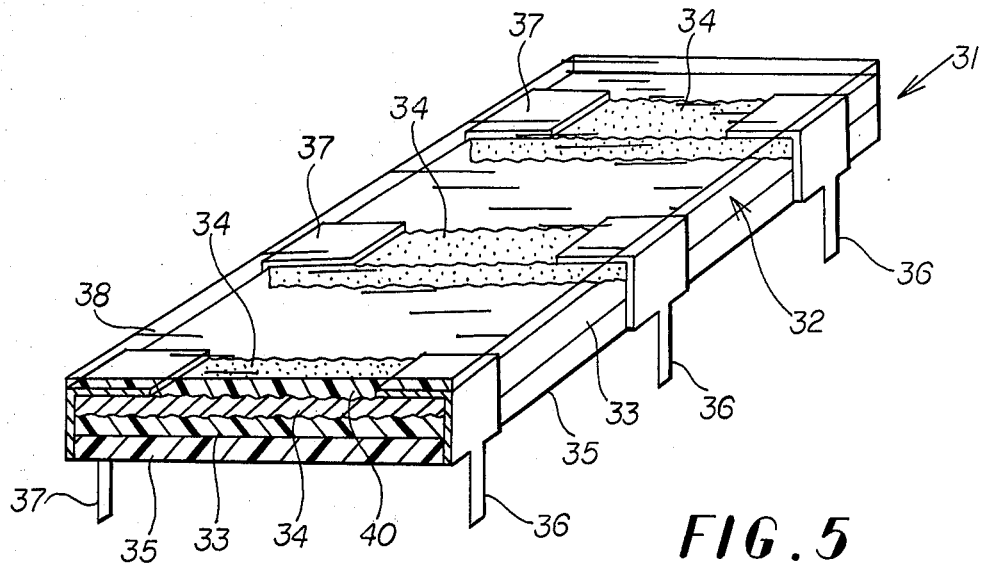
FIG. 5 is a schematic cross-sectional, perspective view of another embodiment of the invention.

FIG. 5 schematically illustrates another resistor component embodiment 31 in the form of a dual-in-line-package (DIP). A plastic body element 32 includes a planar substrate portion 33 and a plurality of spaced apart, rectilinear carburized plastic resistor portions 34. Again, the body element 32 is preferably formed by selectively directing a laser beam along the planar surface of the substrate 33 so as to carburize the parallel resistor portions 34 that extend between opposite edges of the body element 32. Supporting the body element 32 is a rigid plastic base member 35 retaining a first row of spaced apart DIP leads 36 and a second parallel row of spaced apart leads 37. One end of each of the leads 36 is bent into electrical contact with one end of a different one of the resistor portions 34, the opposite ends of which are connected to bent ends of one of the leads 37. Securing the leads 36 and 37 to the resistor portions 34 are discrete quantities 38 of an electrically conductive epoxy. The bottom surface of the substrate 33 is secured to the member 35 with a suitable adhesive and the entire upper surface thereof is covered with a protective coating 40 that provides structural stability for the carburized resistor portions 34.

Figure 6:
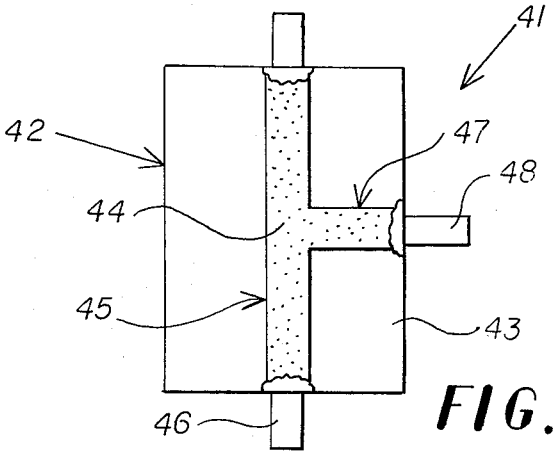
FIG. 6 is a schematic plan view of another embodiment of the invention.

FIG. 6 illustrates another electrical component 41 constructed according to the invention. Again, the component 41 consists of a body portion 42 formed by a plastic substrate portion 43 and a carburized plastic resistor portion 44. The resistor portion 44 extends between opposite edges of the substrate portion 43 and is again preferably formed by selectively directing a laser beam along the surface thereof. As in the embodiment 11 of FIGS. 1–3, first and second electrical conductors 45 and 46, respectively, are electrically connected to opposite ends of the resistor portion 44. However, in this embodiment 41 another resistor portion 47 is formed extending from an intermediate point 49 on the resistor portion 44 and a third edge of the substrate 43. Electrically connected to the other resistor portion 47 is an electrical lead 48.

The embodiment 41 can be used in electrical circuits as a voltage divider. With a fixed input voltage $V_{in}$ applied between the conductors 45 and 46, a given output voltage $V_o$ is available between the conductors 48 and 46. Assuming that the circuit connected to receive $V_o$ draws a negligible current, $V_o$ with respect to the conductor 46 will be equal to $$V_i \times \frac{R1}{R1 + R2}$$

where R1 equals the value of the resistor portion 44 between the conductor 46 and the junction 49 and R2 is the value of the resistor portion 44 between the junction 49 and the conductor 45.

Figure 7:
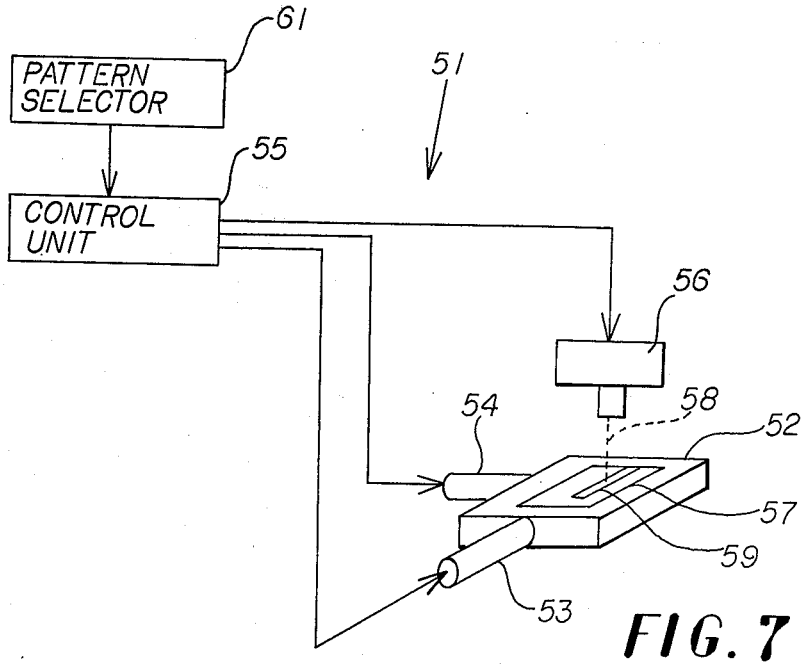
FIG. 7 is a schematic block diagram of a system for producing resistor components according to the present invention.

Referring now to FIG. 7, there is schematically illustrated an automatic system 51 for producing resistor components of the types shown in FIGS. 1–6. The system 51 includes a conventional X-Y positioner table 52 mounted for two-dimensional movement in response to an X-direction servo drive motor 53 and a Y-direction servo drive member 54. Selective positioning of the table 52 in response to energization of the motors 53 and 54 is provided by input signals from a control unit 55. Positioned above the table 52 and also controlled selectively by the control unit 55 is a laser 56. During use of the system 51 a suitable plastic substrate 57 is positioned on the table 52 and moved thereby in a predetermined pattern with respect to a radiation beam 58 produced by the laser 56. Impingement of the laser beam 58 onto the substrate surface 57 carburizes resistor portions 59 thereon having a pattern estabilished by selective energization of the laser 56 and movement of the table 52 in accordance with the inputs from the control unit 55. A pattern selector unit 61 provides for the control unit 55 a programmed input that establishes both movement of the table 52 and energization of the laser 56 so as to establish a desired carburized resistor pattern on the substrate 57.

Resistors produced in accordance with the invention exhibit performance characteristics that compare favorably with conventional carbon resistors. For example, resistor components of the type illustrated in FIGS. 1–3 were produced utilizing the following parameters:

| | |
|---|---|
| Carburizing Energy Source | 4 watt, continuous wave Argon laser having peak power between 488 and 515 nanometers |
| Beam Size | .010 inches |
| Atmosphere | Air |
| Substrate | Kapton films, .005 inches thick |
| Scan Rate | Between 21 and 302 feet per minute |

The resultant resistor elements with cross-sectional areas of between 0.7 and 1.5 mils$^2$ exhibited the following resistance values:

| Scan Rate (ft./min.) | Resistance (ohms 1 inch) |
|---|---|
| 21 | 2800 |
| 30 | 3600 |
| 52 | 11000 |
| 302 | 232000 |

During power handling tests the resistors displayed relatively minor resistance changes of less than one percent when subjected to $\frac{1}{8}$ watts of power for a 24-hour period. The resistors displayed a substantially linear decrease in resistance value of between 0–5 percent when subjected to environmental temperatures between 25°–125° C. and an increase of between 0–5 percent when subjected to temperatures between 25° and −75° C. All of these results are consistent with those experienced with conventional carbon resistors and indicative of pure carbon in the absence of organic binders.

Obviously, many modifications and variations of the present invention are possible in light of the above teachings. It is to be understood, therefore, that the invention can be practiced otherwise than as specifically described.

What is claimed is:

1. An electrical component comprising:

an insulator substrate portion of a homogeneous organic body element and a carburized conductive resistor portion means formed from said homogeneous organic body element;

a first electrical conductor electrically connected to one location on said resistor portion means so as to form one terminal for connection to an electrical circuit; and a second electrical conductor electrically connected to said resistor portion means at a different location spaced from said one location so as to form another terminal for connection to an electrical circuit.

2. An electrical component according to claim 1 including electrically conductive fastener means securing said conductors to said resistor portion means.

3. An electrical component according to claim 2 wherein said fastener means comprises electrically conductive epoxy.

4. An electrical component according to claim 2 including an electrically insulative coating over said resistor portion means.

5. An electrical component according to claim 4 wherein said coating encapsulates said body element.

6. An electrical component according to claim 5 wherein said substrate portion is a plastic.

7. An electrical component according to claim 6 wherein said substrate portion is a polyimide.

8. An electrical component according to claim 2 wherein said substrate portion is a cylinder and said resistor portion is formed as a spiral on the cylindrical surface thereof.

9. An electrical component according to claim 8 wherein said fastener means comprise conductive end caps on the ends of said cylinder.

10. An electrical component according to claim 1 wherein said resistor portion means comprises a plurality of discrete carburized resistor portions spaced apart on said substrate portion and including a plurality of said first conductors, one connected to each of said resistor portions and a plurality of said second conductors, one connected to each of said resistor portions.

11. An electrical component according to claim 10 including electrically conductive fastener means securing said conductors to said resistor portion means.

12. An electrical component according to claim 11 including an electrically insulative coating over said resistor portion means.

13. An electrical component according to claim 1 wherein said resistor portion means comprises a discrete carburized resistor portion having ends electrically connected to said first and second electrical conductors.

14. An electrical component according to claim 13 including a third electrical conductor electrically connected to said resistor portion at a position between said ends thereof.

15. An electrical component according to claim 14 including electrically conductive fastener means securing said conductors to said resistor portion means.

16. An electrical component according to claim 15 including an electrically insulative coating over said resistor portion means.

17. A method of making electrical components comprising the steps of:

forming a homogeneous organic substrate;

applying heat so as to carburize only a predetermined conductive resistor portion of said substrate and leave an insulator substrate portion thereof;

attaching a first electrical conductor to one location on said resistor portion; and attaching a second electrical conductor to said resistor portion at a different location spaced from said one location.

18. A method according to claim 17 wherein said applying step comprises directing a laser beam on said substrate so as to carburize said resistor portion thereof.

19. A method according to claim 17 including the step of fixing said resistor portion to said conductors with an electrically conductive fastener means.

20. A method according to claim 19 wherein said fixing step comprises applying an electrically conductive epoxy.

21. A method according to claim 19 including the step of covering said resistor portion with an electrically insulative coating.

22. A method according to claim 21 wherein said applying step comprises directing a laser beam on said substrate so as to carburize said resistor portion thereof.

* * * * *